US006390471B2

(12) United States Patent
Shinbo et al.

(10) Patent No.: US 6,390,471 B2
(45) Date of Patent: May 21, 2002

(54) APPARATUS FOR DETECTING PASSAGE OF A GAME MEDIUM AND A GAME MACHINE EMPLOYING SAME

(75) Inventors: Toshiaki Shinbo; Jinichi Matsumoto; Sumito Oda; Isamu Kubota; Shinichi Odake, all of Tokyo (JP)

(73) Assignee: Namco Ltd., Toyko (JP)

( * ) Notice: Subject to any disclaimer, the term of this patent is extended or adjusted under 35 U.S.C. 154(b) by 0 days.

(21) Appl. No.: 09/783,612

(22) Filed: Feb. 15, 2001

(30) Foreign Application Priority Data

Feb. 17, 2000 (JP) ..... 2000-040165

(51) Int. Cl.[7] ..... A63F 9/00
(52) U.S. Cl. ..... 273/126 A; 273/108
(58) Field of Search ..... 273/118 A, 119 A, 273/121 A, 108, 138.2, 126 A; 250/206, 215

(56) References Cited

U.S. PATENT DOCUMENTS 4,927,145 A * 5/1990 Davis ..... 273/126 A
5,171,012 A * 12/1992 Dooley ..... 273/108
5,171,013 A * 12/1992 Dooley ..... 273/108
5,667,217 A * 9/1997 Kelly et al. ..... 273/108
5,702,308 A * 12/1997 Alexander, Jr. ..... 473/116

FOREIGN PATENT DOCUMENTS

JP 3202092 * 9/1991
JP 10179926 * 7/1998

* cited by examiner

*Primary Examiner*—Raleigh W. Chiu
(74) *Attorney, Agent, or Firm*—Leydig, Voit, & Mayer, Ltd.

(57) ABSTRACT

In a game medium passage detecting apparatus, optical sensors are arranged in correspondence with detection areas which are adjacent to one another in a cross direction of a game board surface. Each of the optical sensors has a light emitting element and a photoelectric detecting element. The light emitting elements and the photoelectric detecting elements are arranged such that the optical axis of the detection light extends in the direction which crosses a flat surface containing an axis extending in the depth direction of the game board surface parallel to the game board surface, crosses an axis perpendicular to the game board surface, and passes obliquely through the game board surface.

12 Claims, 5 Drawing Sheets

APPARATUS FOR DETECTING PASSAGE OF A GAME MEDIUM AND A GAME MACHINE EMPLOYING SAME

CROSS REFERENCE TO RELATED APPLICATION

This application is based on Application No. 2000-040165, filed in Japan on Feb. 17, 2000, the contents of which are hereby incorporated by reference.

BACKGROUND OF THE INVENTION

1. Field of the Invention

The present invention relates in general to an apparatus for detecting a passage of a game medium for use in a game machine. More particularly, the invention relates to a game medium passage detecting apparatus for detecting a game medium which passes through an area of detection or area swept by an optical sensor, and a game machine employing same.

2. Description of the Related Art

In a group of detection areas in which a plurality of detection areas are set adjacent to one another, an optical sensor is employed corresponding to each of the detection areas when detecting the area through which a game medium has passed. Normally, each of the optical sensors has a light emitting element and a photoelectric detecting element which are respectively arranged above and below the corresponding detection area.

In a system in which one optical sensor is arranged for every detection area, however, when medals are employed as the game media and the medals are detected when rolling, it is difficult to reliably detect the passage of the medals since the thickness of each medal is small and the medals swing from side to side while rolling.

In addition, when the width of each of the detection areas is set sufficiently large with respect to the thickness of the medals, since a plurality of optical sensor sets must be arranged in one detection area at intervals smaller than the thickness of each of the medals, there arises a problem that manufacturing the game machine takes a great deal of time and also the game machine becomes expensive.

To date, with respect to game machines employing disc-like game media, there has never been one designed such that, the detection area, among a plurality of detection areas arranged adjacent to one another, through which the game medium has passed is detected. In game machines as described above, if the optical sensors are respectively arranged above and below the detection areas, the number of optical sensors used therein increases, making it impossible to provide an inexpensive game machine.

In order to detect a medal passing through one detection area, although a light emitting element and photoelectric detecting element may be arranged so as to sandwich therebetween the detection areas, as described above, in the case where the detection areas are adjacent to one another, space for arranging the light emitting elements and the photoelectric detecting elements on both sides of each detection area can not be acquired.

SUMMARY OF THE INVENTION

In light of the foregoing, the present invention has been made in order to solve the above-mentioned problems associated with the prior art, and it is therefore an object of the present invention to provide an inexpensive apparatus for detecting the passage of a game medium which has a high detection ability and a game machine employing same.

In order to attain the above-mentioned object, according to the present invention, there is provided a game medium passage detecting apparatus for use in a game machine in which a game medium is rollably moved on a game board surface in the depth direction of the game board surface, for detecting that the game medium has passed through a detection area on the game board surface, the apparatus comprising: a light-cut-off type optical sensor having a light emitting element for emitting a detection light to the detection area, and a photoelectric receiving element which is arranged so as to face the light emitting element and to sandwich the detection area between the light emitting element and the photoelectric receiving element in order to receive the detection light; and a control section for detecting the passage of the game medium, on the basis of the signals from the optical sensor, wherein the light emitting element and the photoelectric receiving element are arranged such that the optical axis of the detection light extends in a direction which crosses a flat surface containing therein an axis extending in the depth direction of the game board surface in parallel with the game board surface and an axis perpendicularly intersecting the game board surface, and also passes obliquely through the game board surface.

According to another aspect of the present invention, there is provided a game medium passage detecting apparatus for use in a game machine in which a game medium is rollably moved on a game board surface in the depth direction of the game board surface, for detecting which of a plurality of detection areas set to be adjacent to one another in the cross direction perpendicular to the depth direction, the game medium has passed through, the apparatus comprising: a plurality of light-cut-off type optical sensors each having a light emitting element for emitting a detection light to the detection areas, and a photoelectric receiving element arranged to face the light emitting element and to sandwich the detection areas between the light emitting element and the photoelectric receiving element in order to receive the detection light; and a control section for detecting which detection area the game medium has passed through, on the basis of signals from the optical sensors, wherein each of the light emitting elements and each of the photoelectric receiving elements are arranged such that the optical axis of the detection light extends in a direction which crosses a flat surface containing therein an axis extending in the depth direction of the game board surface in parallel with the game board surface and an axis perpendicularly intersecting the game board surface, and also passes obliquely through the game board surface.

According to a still further aspect of the present invention, there is provided a game machine comprising: a game board surface; sending means for sending a game medium to move rollably on the game board surface the game medium in the depth direction of the game board surface; and a game medium passage detecting apparatus for detecting which of a plurality of detection areas, which are set adjacent to one another in a cross direction perpendicular to the depth direction, the game medium has passed through, the game medium passage detecting apparatus including: a plurality of light-cut-off type optical sensors each having a light emitting element for emitting a detection light to the detection areas, and a photoelectric receiving element arranged to face respectively the light emitting elements and to sandwich the detection areas between the light emitting element and the photoelectric receiving element in order to receive the detection light; and a control section for detecting which detection area the game medium has passed through, on the basis of signals from the optical sensors, wherein each of the light emitting elements and each of the photoelectric receiving elements are arranged such that the optical axis of the detection light extends in a direction which crosses a flat surface containing therein an axis extending in the depth direction of the game board surface in parallel with the game board surface and an axis perpendicularly intersecting the game board surface, and also passes obliquely through the game board surface.

BRIEF DESCRIPTION OF THE DRAWINGS

The above and other objects as well as advantages of the present invention will become clear by the following description of the preferred embodiments of the present invention with reference to the accompanying drawings, wherein.

DETAILED DESCRIPTION OF THE PREFERRED EMBODIMENTS

The preferred embodiment of the present invention will hereinafter be described in detail with reference to the accompanying drawings.

This embodiment relates, in a shooting game machine in which medals are employed as the game media, to an apparatus for detecting the passage of a game medium which detects each of the medals passing through an associated detection area by an associated optical sensor.

Figure 1:
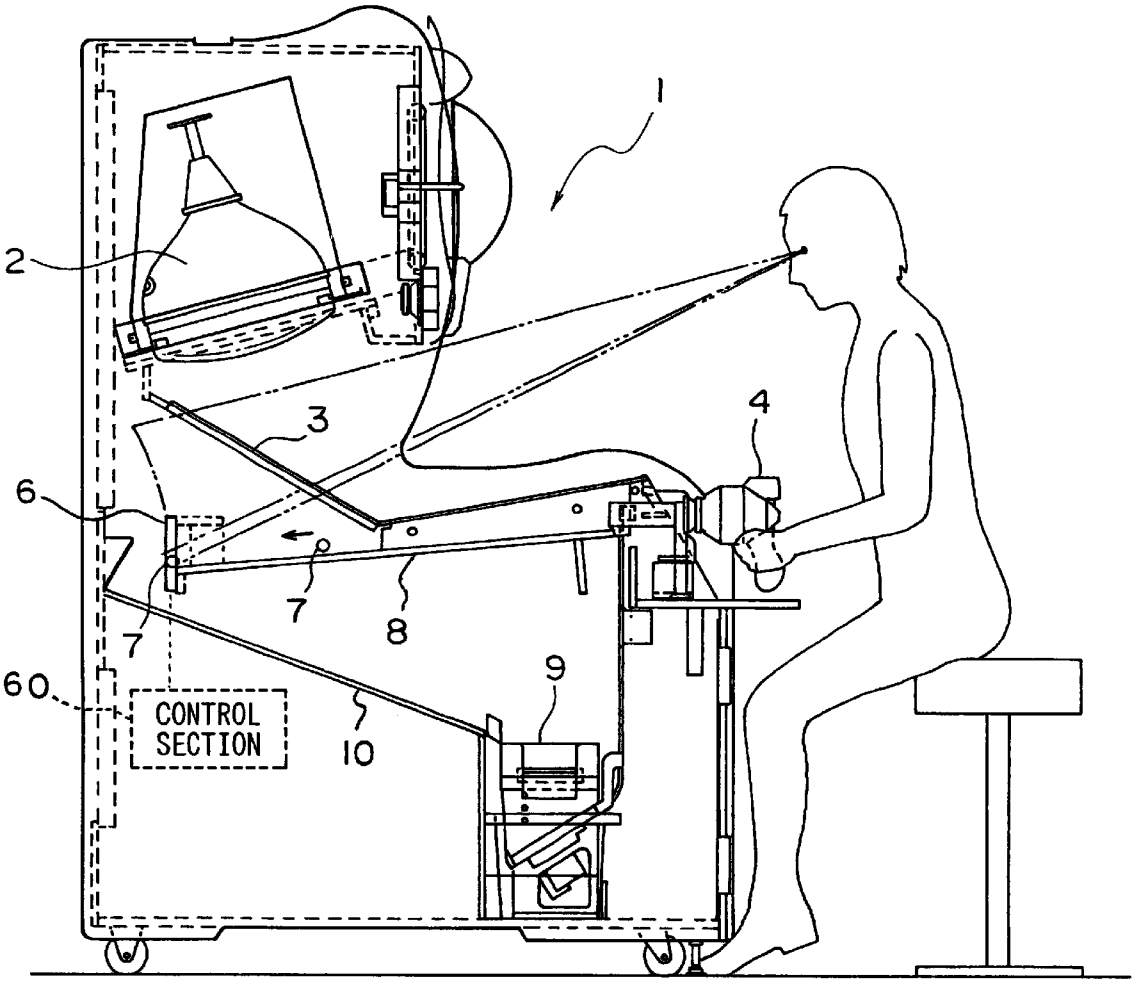
FIG. 1 is a side elevational view showing the construction of a shooting game machine according to an embodiment of the present invention.
Figure 2:
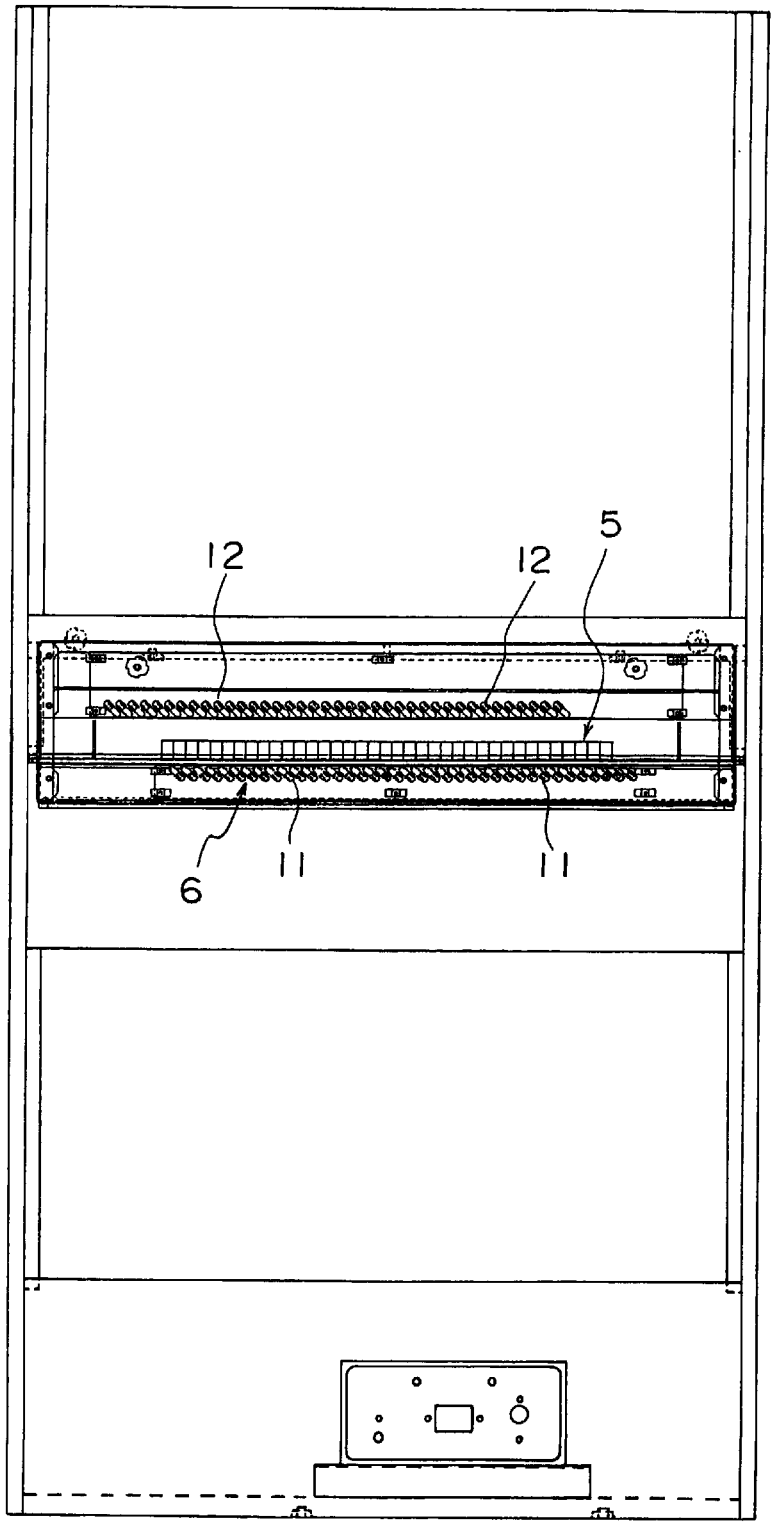
FIG. 2 is a front view showing the construction of a main part of an apparatus for detecting the passage of a game medium shown in FIG. 1.
Figure 3:
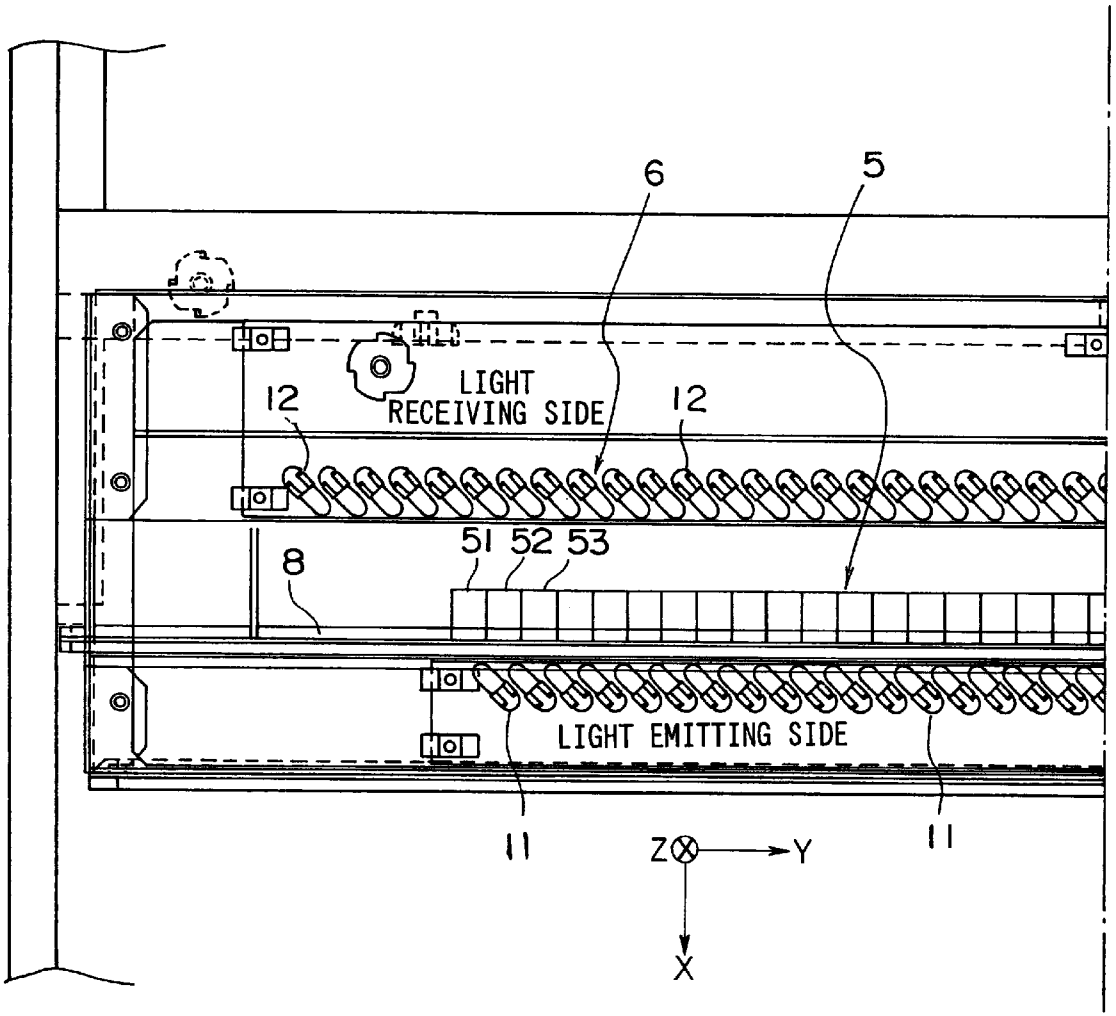
FIG. 3 is an enlarged view of a main part of the apparatus for detecting the passage of a game medium shown in FIG. 2.
Figure 4:
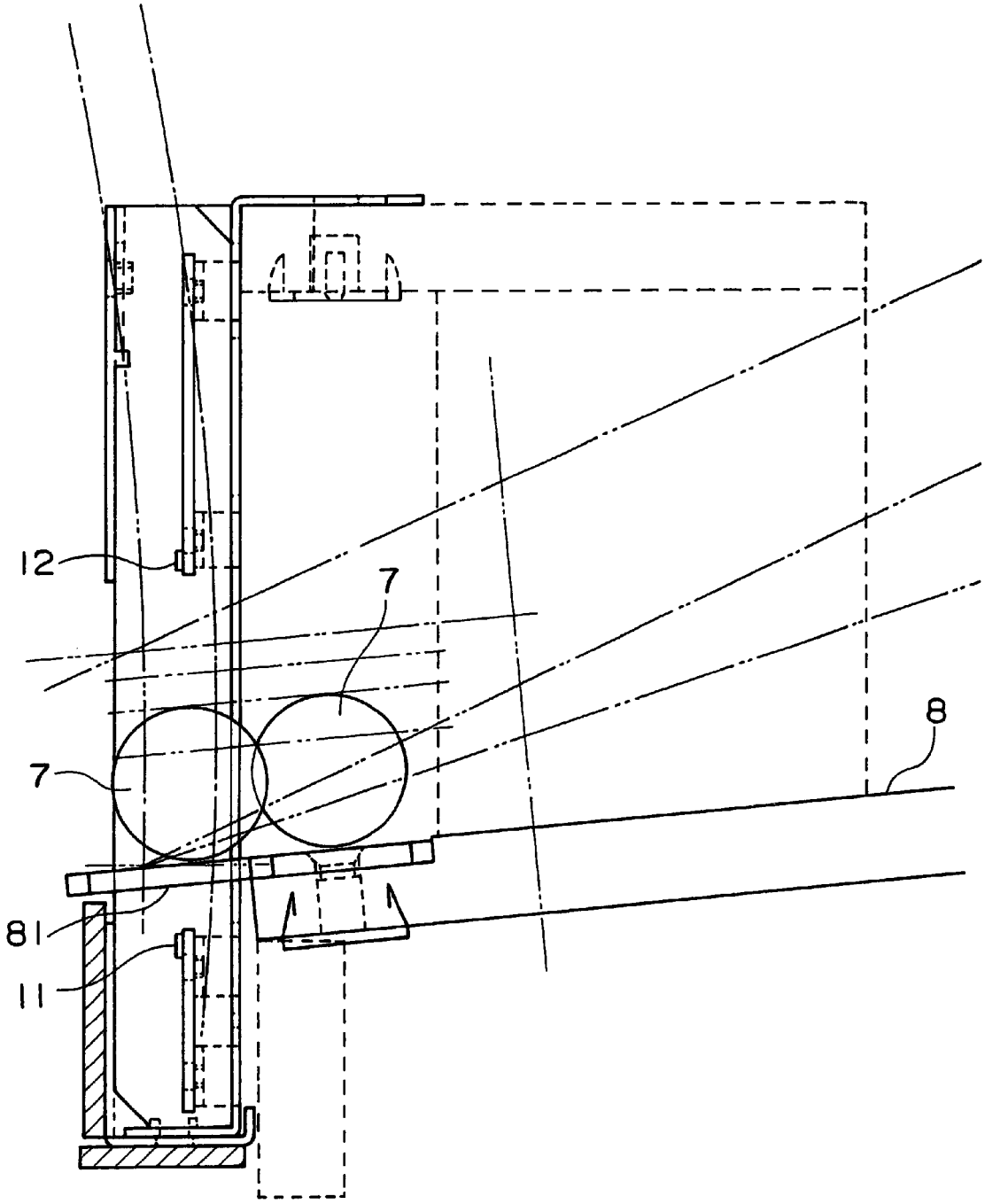
FIG. 4 is a side elevational view showing the construction of the apparatus for detecting the passage of a game medium shown in FIG. 3.

FIG. 1 is a side elevational view showing the construction of a shooting game machine according to one embodiment of the present invention; FIG. 2 is a front view showing the construction of a main part of an apparatus for detecting the passage of a game medium shown in FIG. 1 (a view when viewed from a player side of FIG. 1); FIG. 3 is an enlarged view of a main part of the apparatus for detecting the passage of a game medium shown in FIG. 2; and FIG. 4 is a side elevational view showing the construction of the apparatus for detecting the passage of a game medium shown in FIG. 3.

In FIGS. 1 to 3, this shooting game machine 1 includes: a downwardly sloped game board surface 8; a monitor 2 which is arranged above the game board surface 8 so as to face it to project thereto the game contents; a half mirror 3 which is arranged between the game board surface 8 and the monitor 2; a medal shooting unit 4; a plurality of light-cut-off type optical sensors 6; a control section 60; a medal collecting receptacle 9; and a collecting groove 10.

The half mirror 3 reflects the image from the monitor 2 to show the virtual image thereof to a player. The medal shooting unit 4 sends out a medal 7 as a disc-like game medium onto the game board surface 8 so that the medal 7 is rollably moved in the depth direction (to the left in FIG. 1) of the game board surface 8.

The optical sensors 6 are arranged in correspondence to the group 5 of detection areas which are set on the game board surface 8. The control section 60 controls the optical sensors 6, and detects that the medal 7 has passed through the group of detection areas 5 on the basis of the signals from the optical sensors 6. The apparatus for detecting the passage of a game medium in this embodiment has a plurality of optical sensors 6 and the control section 60.

The medal 7 which has been shot towards the target, which is projected on the half mirror 3, from the medal shooting unit 4 is rollably moved on the game board surface 8 to pass through the detection area group 5 or go wild to pass therethrough. In any case, the medal 7 is collected in the medal collecting receptacle 9 through the collecting groove 10.

In FIGS. 3 and 4, the detection area group 5 includes a plurality of detection areas 51, 52, 53, . . . which are arranged on the game board surface 8 so as to be adjacent to one another in the cross direction perpendicular to the depth direction of the game board surface 8.

In this connection, while each of the detection areas 51, 52, 53, . . . is expressed in the drawings in the form of a rectangular frame, the rectangular frames are not actually present, and each of the detection areas 51, 52, 53, . . . is only shown virtually. Of course, a rectangular frame member formed of a light-transmissive member may be actually provided, but then inconveniences such as the medal 7 colliding with the frame member and falling down occur. This is not preferable in terms of the management of the game.

A plurality of light emitting elements 11 for emitting the detection light to the corresponding detection areas 51, 52, 53, . . . are arranged under the detection area group 5. In addition, above the detection area group 5, a plurality of photoelectric receiving elements 12 for receiving the detection light are arranged so as to face the corresponding light emitting elements 11 and to sandwich the detection areas 51, 52, 53, . . . between the light emitting elements 11 and the photoelectric receiving elements 12. Each optical sensor 6 comprises the light emitting element 11 and the photoelectric receiving element 12. In this example, the line of the light emitting elements 11 on the lower side and the line of the photoelectric receiving elements 12 on the upper side are arranged in parallel with the detection area group 5.

In this connection, in FIG. 4, since the line of the light emitting elements 11 are arranged under the game board surface 8, a part of the game board surface 8 is made of a light-transmissive member 81 such that the detection light which have been emitted from the light emitting elements 11 is transmitted through the game board surface 8.

The light emitting elements 11 and the photoelectric receiving elements 12 are arranged such that the optical axis of each of the detection lights extends in the direction which crosses the flat surface containing therein the axis (the Z-axis in FIG. 3) extending in the depth direction of the game board surface 8 in parallel with the game board surface 8 and the axis (the X-axis in FIG. 3) perpendicularly intersecting the game board surface 8, and passes obliquely through the game board surface 8. In addition, in this embodiment, the axis of each of the detection lights extends in parallel with the flat surface containing therein both the X-axis and the Y-axis in FIG. 3.

Now, when it is assumed that each of the detection areas 51, 52, 53, . . . is a rectangular frame, in order that one of optical sensor 6 is responsible for the detection through one detection area, the light receiving element 11 and the photoelectric receiving element 12 may be arranged on the diagonal line of the rectangular frame such that one optical axis crosses the rectangular frame. At this time, the height of the rectangular frame must to be smaller than the diameter of the medal 7.

However, the medal 7 does not necessarily roll while maintaining an upright state. Hence, the medal 7 may roll unsteadily left and right, or may roll as if it is about to fall in some cases.

In such cases, with the method of arranging the optical sensors 6 so that one optical axis passes obliquely through one detection area, there is the possibility that the medal 7 may pass through the detection area in such a way as not to cut off the obliquely extending optical axis.

In order to solve this problem, in this embodiment, the optical sensors 6 are arranged such that a plurality of optical axes pass through the detection areas 51, 52, 53, . . . in parallel with one another. In other words, the detection light not only passes through the corresponding detection area but also the detection areas adjacent to the corresponding detection area as well.

In this case, while medals 7 passing through the detection areas 51, 52, 53, . . . may cut off a plurality of optical axes in some cases, when specifying which detection area a medal 7 has passed through, the following method is used.

That is, in the case where the cut-off of detection light is detected simultaneously by a plurality of photoelectric receiving elements 12 adjacent to one another when a medal 7 has passed therethrough, the control section 60 judges that the medal 7 has passed through the detection area corresponding to the photoelectric receiving element 12, which is located at the end of a predetermined side of a plurality of photoelectric receiving elements 12 each of which has detected the cut-off of detection light. For example, in the example shown in FIG. 3, the control section 60 judges that the medal 7 has passed through the detection area corresponding to the detection light on the left end side of all the detection light which has been cut off. Of course, when only one detection light is cut off, it is judged that the medal 7 has passed through the detection area corresponding thereto.

In this connection, even though in this example the optical sensors 6 are arranged, as shown in FIG. 3, such that each of the axes which is used to determine the detection areas, passes obliquely through the bottom right corner of each detection area, the arrangement may be adopted in which the inclination of the optical axes is reversed so that each of the optical axes passes through the bottom left corner of each detection area. In this case, the detection area of interest may be judged with the optical axis on the right end side, of the cut-off optical axes, as the reference.

In addition, in the case where the distance between adjacent photoelectric receiving elements 12 is small, there is even a possibility of a photoelectric receiving element 12 receiving detection light for an adjacent photoelectric receiving element 12 if detection light is simultaneously emitted from all of the light emitting elements 11. Therefore, in this example, a method of successively reading out the data from the optical sensors 6 from one set to another, e.g., the method of the scanning from the left end to the right end of FIG. 3.

In addition thereto, for example, there may be adopted the method wherein five continuous optical sensors 6 (five detection areas) are treated as one block, and the scanning is carried out in every block to detect the passage of the medals 7. In such a way, a plurality of optical sensors 6 are divided into a plurality of blocks, and then the scanning is repeatedly carried out in every block. Thus, even in the case where the detection area group 5 is long, the passage of the medals 7 can be surely and quickly detected.

As described above, in the case where a plurality of optical axes are obliquely transmitted through the detection areas 51, 52, 53, . . . , it is preferable that the light emitting elements 11 and the photoelectric receiving elements 12 are arranged such that the optical axes become parallel with one another. Further, in order to specify the detection area through which a medal 7 has passed, it is preferable that the parallel intervals of the optical axes are set equally.

Next, the game machine will hereinbelow be described in detail. In the present game machine, the medal shooting unit 4 is employed as the sending means for sending a medal 7 towards the target. This medal shooting unit 4 is constructed such that a lever is operated against a suppression member which is pressed downwardly by a spring to push out a medal 7 towards the target, whereby the medal rolls with great force on the game board surface 8 while maintaining an upright state.

As other examples of the means for sending out the medal, there may be employed a unit having a lever which is swung by the rotation of a motor to flick out a medal 7, a long groove which is used in conventional medal games or the like.

In addition, as the target generating means for making a target appear in front of the game board surface 8, a combination of the monitor 2 and the half mirror 3 is employed. The monitor 2 and the half mirror 3 are arranged so as to fulfill the positional relationship in which the image containing the target of the monitor 2 is in view of a player, and also so the medal 7 rolling on the game board surface 8 is in view of a player until it has overlapped with the target.

Figure 5:
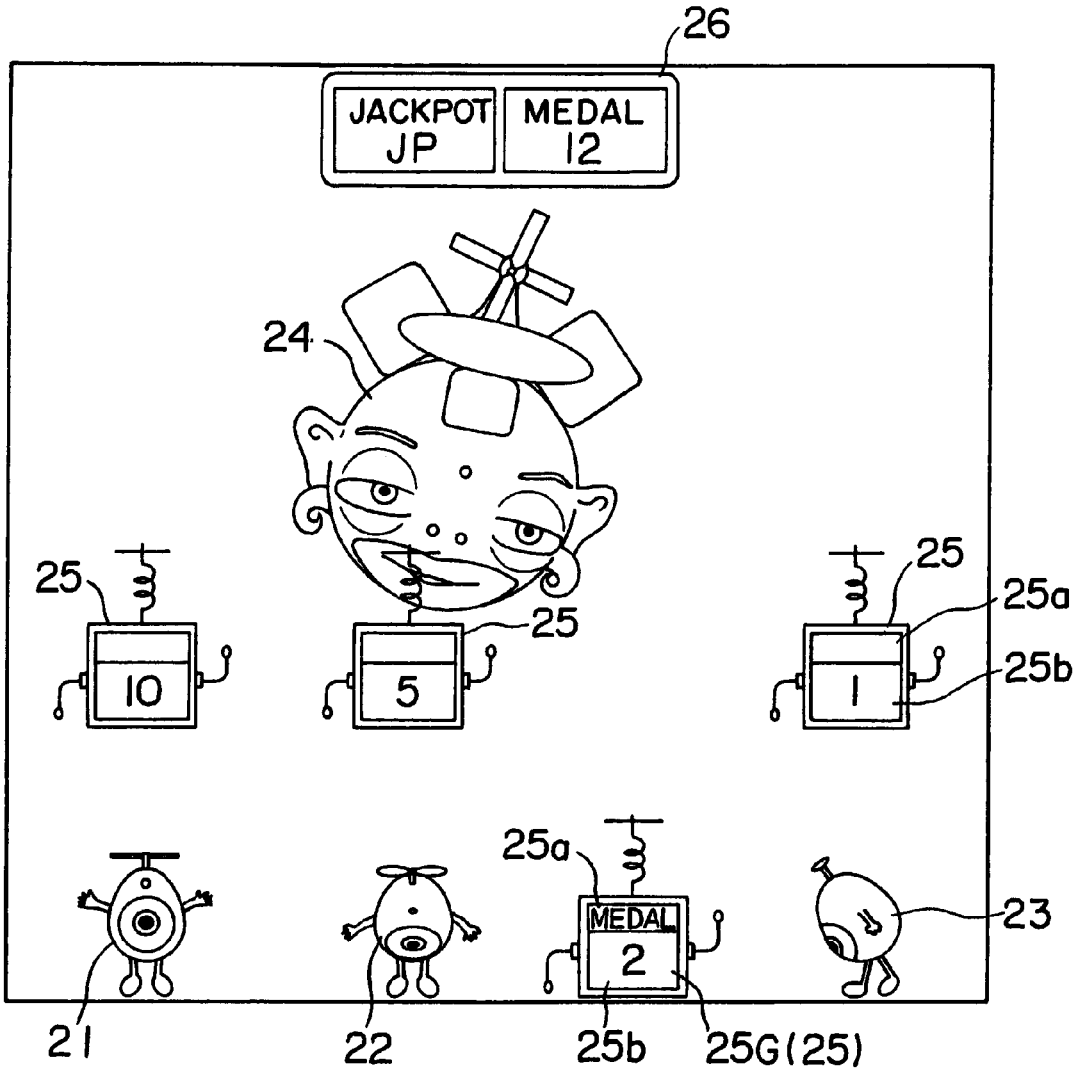
FIG. 5 is a schematic view useful in explaining one example of the game contents of the shooting game machine shown in FIG. 1.

In FIG. 5, the image which is in view of a player is generated such that the target appears in correspondence to the detection areas 51, 52, 53, . . . in FIG. 3. That is, while targets 21, 22 and 23 shown in FIG. 5 are generated so as to have a width corresponding to two adjacent detection areas, the present invention is not limited thereto. That is, targets with widths having one-to-one correspondence with the detection areas, or a target 24 with a width corresponding to three or more detection areas may be generated.

Furthermore, above the heads of the targets 21, 22 and 23, lottery boxes 25 for displaying thereon the number of medal repayment, the increasing number of medal repayment in a jackpot, the number of target hits for the bonus game, misses, and the amount thereof are respectively generated.

Next, the game contents will hereinbelow be described with reference to FIGS. 1 and 5.

A player puts a medal 7 into the model shooting unit 4 and then shoots the medal 7 aiming at the targets 21 to 23 which are projected in front of the game board surface 8.

The targets 21 to 23 paired with the lottery boxes 25 are moved vertically. Then, if the medal 7 passes through any of the detection areas corresponding to the targets 21 to 23 when the targets 21 to 23 are landed, then it is judged that the medal 7 has hit one of the targets 21 to 23.

When it is judged that the medal 7 has hit any of the targets 21 to 23, the judgement for the lottery is carried out and then the corresponding target 21, 22 or 23 disappears from the screen. Then, the displayed lottery boxes 25 drop above the heads of the corresponding target 21, 22 or 23 to display the lottery result.

For the lottery result, first of all, the rotating numerical characters are stopped to display the amounts thereof on lower windows 25*b* of the lottery boxes 25, respectively. Next, the operating conditions for the amounts thereof are respectively displayed on upper windows 25*a*. The display of the operating conditions means the display in the lower windows 25*b* of the number of medals 7 to be paid, the increase in the number of medals to be paid in a jackpot, or the number of targets 24 hit for the bonus game, or the amount that has become invalid to be misses each having no special favor, for example by displaying "MEDAL", "JACKPOT", "BOSS" or "MISS".

For example, in the case where as shown in FIG. 5, "MEDAL" and "2" are respectively displayed on the upper window 25*a* and the lower window 25*b* of the lottery box 25G, two medals are repaid to a player.

In addition, in the case where "BOSS" and "1" are respectively displayed on the upper window 25*a* and the lower window 25*b,* the target 24 for the bonus game which is being floated in the center drops only one step. This target 24 for the bonus game, similar to the targets 21 to 23, is also set such that the medal 7 does not hit the target 24 as long as it is not landed.

Further, in the case where "JACKPOT" and "10" are respectively displayed on the upper window 25*a* and the lower window 25*b,* the repayment number of the jackpot display 26 which is displayed on the upper part of the monitor 2 is increased.

Furthermore, in the case where "MISS" is displayed on the upper window 25*a,* even if any numerical character other than "0" is displayed on the lower window 25*b,* the associated one of these numerical characters becomes invalid, and hence there are no special favors such as the repayment of medals 7 at all.

If a medal hits the bonus game target 24 which has landed, then the game proceeds either to the bonus game in which the targets 21 to 23 are kept on the ground for a fixed period of time, or to the jackpot state in which the number of medals displayed on the jackpot display 26 are repaid to a player.

In this connection, it is not intended that the present invention is limited to the above-mentioned game contents, and hence in addition thereto, various presenations may be adopted.

In addition, while in the above-mentioned game machine of this embodiment, medals are employed as the game media, it is to be understood that the present invention is not intended to be limited thereto, and hence the same effects as those of the above-mentioned game machine can be offered as long as the game medium has a disc shape.

In addition, for the target generating means, actual targets may be made to appear or image display means such as a cathode ray tube (CRT) or a liquid crystal display device may be employed such that a player aims directly at the targets which are projected by the image display means to shoot the game media towards the targets. Alternatively, by employing the half mirror, the actual objects or the images from the image displaying means may be shown indirectly to the player.

In addition, when a player aims directly at the targets which are displayed by the image displaying means, collecting means such as a groove for collecting the game media may be provided in front of the image displaying means.

By adopting the above-mentioned construction, when detecting the passage of the game medium such as a medal 7, even in the case where the game medium is thin, or the width of each of the detection areas is sufficiently wide compared with the game medium, the passage of the game medium can be more surely detected. Thus, it is possible to provide an inexpensive apparatus for detecting the passage of a game medium which has a higher detection ability compared with a conventional apparatus.

In addition, since the optical axes of a plurality of optical sensors 6 obliquely cross the detection areas 51, 52, 53, . . . , it is even possible to readily detect a medal 7 which is rolling while swinging from side to side, or which is rolling in a lower position as if it is about to fall.

Further, according to the present invention, it is possible to provide an inexpensive apparatus for detecting the passage of a game medium in which the medal 7 can be used as the game medium irrespective of the size of the diameter thereof.

Furthermore, it is possible to provide an inexpensive and novel game machine with which the play, the direction and the like which have not been conventionally realized are possible.

While the present invention has been particularly shown and described with reference to the preferred embodiment and the specified modifications thereof, it will be understood that the various changes and other modifications will occur to those skilled in the art without departing from the scope and true spirit of the invention. The scope of the invention is therefore to be determined solely by the appended claims.

What is claimed is:

1. A game medium passage detecting apparatus for use in a game machine in which a game medium rolls on a game board surface in a depth direction of the game board surface, for detecting that the game medium has passed through a detection area on the game board surface, said apparatus comprising:

a light-cut-off optical sensor having a light emitting element for emitting detection light to a detection area, and a photoelectric detecting element facing said light emitting element and sandwiching the detection area to detect the detection light; and a control section for detecting passage of the game medium, based on signals from said optical sensor, wherein said light emitting element and said photoelectric detecting element are arranged so that an optical axis of the detection light extends in a direction which crosses a flat surface containing an axis extending in a depth direction of the game board surface parallel to the game board surface, crosses an axis perpendicular to the game board surface, and passes obliquely through the game board surface.

2. The game medium passage detecting apparatus according to claim 1, wherein the game medium has a disc shape.

3. The game medium passage detecting apparatus according to claim 2, wherein the game medium is a medal.

4. A game medium passage detecting apparatus for use in a game machine in which a game medium rolls on a game board surface in a depth direction of the game board surface, for detecting which of a plurality of detection areas, set adjacent to one another in a cross direction, perpendicular to the depth direction, the game medium has passed through, said apparatus comprising:

a plurality of light cut-off optical sensors, each sensor having a light emitting element for emitting detection light to detection areas and a photoelectric detecting element facing said light emitting element and sandwiching one of the detection areas to detect the detection light; and a control section for detecting which detection area the game medium has passed through, based on signals from said optical sensors, wherein each pair of said light emitting elements and photoelectric detecting elements of said optical sensors is arranged so that an optical axis of the detection light extends in a direction which crosses a flat surface containing an axis extending in a depth direction of the game board surface, parallel to the game board surface, crosses an axis perpendicular to the game board surface, and passes obliquely through the game board surface.

5. The game medium passage detecting apparatus according to claim 4, wherein said light emitting elements and said photoelectric detecting elements are arranged such that a plurality of optical axes pass through one detection area, parallel to one another.

6. The game medium passage detecting apparatus according to claim 5, wherein when blocking of the detection light is simultaneously detected by the plurality of photoelectric detecting elements adjacent to one another, said control section determines that the game medium has passed through the detection area corresponding to said photoelectric detecting element located at an end part of a side of the plurality of photoelectric detecting elements which have detected the blocking of the detection light.

7. The game medium passage detecting apparatus according to claim 4, wherein said plurality of optical sensors are divided into a plurality of blocks, and said control section detects the passage of the game medium by repeatedly scanning every block.

8. The game medium passage detecting apparatus according to claim 4, wherein said light emitting elements and said photoelectric detecting elements are arranged such that the optical axes of the detection light arranged at equal intervals, parallel to one another.

9. The game medium passage detecting apparatus according to claim 4, wherein the game medium has a disc shape.

10. The game medium passage detecting apparatus according to claim 9, wherein the game medium is a medal.

11. A game machine comprising:

a game board surface;

sending means for sending a game medium rolling on said game board surface in a depth direction of said game board surface; and a game medium passage detecting apparatus for detecting which of a plurality of detection areas, which are adjacent to one another in a direction perpendicular to the depth direction, the game medium has passed through, said game medium passage detecting apparatus including:

a plurality of light-cut-off optical sensors, each sensor having a light emitting element for emitting a detection light to the detection areas and a photoelectric detecting element facing the light emitting element and sandwiching the detection areas between said light emitting element and said photoelectric detecting element to detect the detection light; and a control section for detecting which detection area the game medium has passed through, based on signals from said optical sensors, wherein each pair of said light emitting elements and said photoelectric detecting elements of said optical sensors is arranged so that an optical axis of the detection light extends in a direction which crosses a flat surface containing an axis extending in a depth direction of the game board surface, parallel to the game board surface, crosses an axis perpendicular to the game board surface, and passes obliquely through game board surface.

12. The game machine according to claim 11, further comprising target generating means for making targets appear in correspondence with the detection areas.

* * * * *